United States Patent [19]

Ghibaudo et al.

[11] Patent Number: 4,552,500

[45] Date of Patent: Nov. 12, 1985

[54] REFUSE HAULING AND STORAGE APPARATUS

[76] Inventors: Jose A. Ghibaudo, 12703 Alconbury, Cerritos, Calif. 90701; Eduardo J. Ghibaudo, 7103 De Palma St., Downey, Calif. 90241

[21] Appl. No.: 611,739

[22] Filed: May 18, 1984

[51] Int. Cl.[4] ..... B65F 3/20

[52] U.S. Cl. ..... 414/408; 414/517; 414/492

[58] Field of Search ..... 414/406, 408, 491, 492, 414/509, 511, 512, 517, 525 R

[56] References Cited

U.S. PATENT DOCUMENTS

| | | | |
|---|---|---|---|
| 2,166,846 | 7/1939 | McCalley | 414/509 |
| 2,741,375 | 4/1956 | Backes | 414/509 |
| 2,808,158 | 10/1957 | Gilleo | 414/509 |
| 2,932,415 | 4/1960 | Brown | 414/515 |
| 3,137,400 | 6/1964 | Tapp et al. | 414/513 |
| 3,170,377 | 2/1965 | Herpich et al. | 414/517 X |
| 3,170,578 | 2/1965 | Moreland | 414/517 X |
| 3,250,414 | 5/1966 | Pioch | 414/406 X |
| 3,263,846 | 8/1966 | Balbi | 414/515 |
| 3,325,024 | 6/1967 | Shubin | 414/406 |
| 3,338,623 | 8/1967 | Morrison | 414/406 X |
| 3,363,933 | 1/1968 | Wilson | 296/184 |
| 3,672,520 | 6/1972 | Linville | 414/525 R |
| 3,768,672 | 10/1973 | Grooss | 414/517 |
| 3,802,585 | 4/1974 | Churchman | 414/517 |
| 3,865,260 | 2/1975 | Wieschel et al. | 414/517 |
| 3,899,090 | 8/1975 | Telesio | 414/513 |
| 3,901,394 | 8/1975 | Bowles | 414/511 |
| 3,966,096 | 6/1976 | Worthington | 414/517 X |
| 4,089,435 | 5/1978 | Corompt | 414/509 X |
| 4,230,359 | 10/1980 | Smith | 414/408 |

FOREIGN PATENT DOCUMENTS

| | | | |
|---|---|---|---|
| 1677883 | 1/1984 | Australia . | |
| 0078011 | 5/1983 | European Pat. Off. | 414/406 |
| 2262288 | 6/1974 | Fed. Rep. of Germany | 414/525 |
| 2450455 | 5/1976 | Fed. Rep. of Germany | 414/525 |
| 2818821 | 11/1979 | Fed. Rep. of Germany | 414/517 |
| 383656 | 9/1973 | U.S.S.R. | 414/517 |

*Primary Examiner*—Robert G. Sheridan
*Assistant Examiner*—Ken Muncy
*Attorney, Agent, or Firm*—Cislo, O'Reilly & Thomas

[57] ABSTRACT

This invention relates, in one embodiment, to a refuse handling device having an elongated frustro-conical body of uniform octagonal cross-section with a loading opening and a spaced discharge opening. There is disclosed a compactor having a two-part compacting platen adapted to guide refuse entering the body through the upper loading opening into a position to be acted upon by the lower part of the compacting platen and capable of longitudinal movement within the body. The body is pivotally mounted on a chassis and is capable of pivoting upwardly away from the chassis to dump refuse contained in the body out through the discharge opening. An alternate embodiment of the invention in a side loading refuse handling device is also disclosed.

14 Claims, 7 Drawing Figures

REFUSE HAULING AND STORAGE APPARATUS

BACKGROUND OF THE INVENTION

This invention relates to a refuse hauling apparatus of a new type intended for use with front-end or side loading vehicles.

This invention relates more particularly to a container mounted on a vehicle chassis for use as a front-end or a side loading vehicle and is provided with a compacter and dumping means. A container of this type is used for collecting and transporting loose objects and, in particular, household or commercial refuse.

In the type of operation envisioned here where the invention is used with a front-end loading vehicle, the refuse is initially placed in a large refuse collection container which may be used as a storage bin for the refuse until the collection container becomes filled. The filled collection container is then emptied by a front-end loader with the collection container being picked up by lifting arms and forks which engage the collection container to raise it in a rearward arcuate fashion above a storage body positioned on the refuse storage collection vehicle. After being raised in a rearward arcuate fashion above the refuse storage body, the collection container is inverted to dump its contents into the hopper section of the refuse storage body. The collection container is then returned to ground level. In picking up the collection container, the collection container is generally positioned forwardly of the refuse collection vehicle and is lifted over the cab of the vehicle in a rearward arcuate fashion to a position above the hopper section of the refuse storage body. The mode of operation of the refuse collection apparatus with the refuse collection container positioned in front of the vehicle and being raised in a rearward arcuate fashion over the cab of the vehicle during pick-up, accounts for the name "front-end loader."

The invention also relates to a container mounted on a alternate vehicle chassis for use as a side loading vehicle.

The container of the invention, mounted on a vehicle chassis for use as a side loading vehicle operates as described below. Instead of having a large quantity of refuse placed in a centrally located number of large refuse collection containers, the side loading vehicle is best used where numerous small pick ups must be made, as in a residential neighborhood where each household places its refuse out at the curb. In an optimum situation, one individual is responsible to drive the vehicle while one to two other individuals collect the individual piles of refuse and toss them into the hopper section of the refuse storage body by hand. Similar to the name "front-end loader", the mode of operation of the refuse collection apparatus with the refuse being tossed into the hopper section of the refuse storage body by hand from the side of the vehicle during pick up, accounts for the descriptive label of "side loader."

Through use of a front-end or a side loader, the refuse, after being dumped into the hopper section of the storage body of the vehicle, is compacted through rearward movement of a compaction panel within the storage body. In its movement, the compaction panel is positioned forwardly of the hopper section opening into the refuse storage body. Then, after the dumping of refuse into the body through the hopper section opening, the compaction panel is moved rearwardly to compact the refuse against the tailgate which is pivotally mounted on the storage body to close a rear opening in the storage body. After rearward movement of the compaction panel to pack the refuse, the compaction panel is moved forward in preparation for packing additional refuse as it is dumped through the hopper section opening into the storage body.

After a period of time the refuse storage body for the collection vehicle will become filled with refuse. It is then necessary for the refuse collection vehicle to make a trip to a dumping point to unload the refuse. This is accomplished by moving the tailgate in an arcuate manner to a raised position and then dumping the refuse from the refuse storage body by elevating the front end of the storage body upwardly in an arcuate fashion away from the carrying vehicle chassis thereby dumping refuse out of the rear opening.

OBJECTS AND SUMMARY OF THE INVENTION

It is a general object of the present invention to provide refuse collection and hauling apparatus, specifically a refuse collection vehicle wherein the refuse may be packed to a high degree, thereby providing a refuse collection vehicle with large refuse carrying capacity per unit volume of space.

It is another object of this invention to provide refuse collection and hauling apparatus wherein the contents may be packed or compressed to a substantial extent without damaging the container body of the refuse collection and hauling apparatus and without being misdirected.

It is another object of this invention to provide refuse collection and hauling apparatus provided with a packing platen system which may be driven from a conventional vehicle motor without expensive modification thereof.

It is another object of this invention to provide refuse collection and hauling apparatus which may be applied substantially universally to the various makes and styles of vehicle chassis.

It is another object of this invention to provide refuse collection and hauling apparatus which is easy and safe to operate and which may be controlled positively by its operators.

It is another object of this invention to provide refuse collection and hauling apparatus provided with means for discharging the collected refuse efficiently.

It is another object of this invention to provide refuse collection and hauling apparatus which is sealed and sanitary and the compacting drive system for which cannot become fouled or jammed by the collected refuse, even though the latter contains wire, metal containers, bottles and similar materials which are difficult to handle.

It is another object of this invention to provide refuse collection and hauling apparatus which, when mounted on a vehicle chassis, has more rear end viewing area, thereby increasing operational safety of the apparatus.

It is still another object of this invention to provide refuse collection and hauling apparatus having better packing and dumping characteristics than existing conventional refuse collection and hauling apparatus.

It is another object of this invention to provide refuse collection and hauling apparatus which is simple in construction, inexpensive to manufacture and operate, strong, durable and efficient in operation and service.

In an exemplary embodiment on a front end loading vehicle, the invention is directed to a refuse collection and hauling apparatus comprising an elongated hollow body arranged for mounting on a motor truck, or the like vehicle chassis, having a cab thereon, the body being of uniform octagonal cross-section throughout its length at any given point, closed on a forward end and open on an opposite rear end, and having an upper hopper loading opening therein spaced longitudinally from said open end for depositing refuse within the body, the forward closed end having an elongated cab canopy portion adapted to project outwardly over the motor truck chassis cab; means on the body for lifting a refuse collection container to dump refuse from the collection container into the body through the upper hopper opening and for thereafter lowering the collection container to ground level; a discharge door member pivotally connected to the body adjacent the opening in the rear end of the body; means for supporting the discharge door for pivotal movement between a first closed position sealing the opening and a second discharge position exposing the opening; hydraulic means operatively coupled to the support means for providing selective movement between the first and second positions; compacting means within the body for longitudinal movement therein to compress rearwardly against the discharge door refuse loaded thereinto through the upper hopper loading opening having a compacting platen mounted for movement longitudinally in the body and having an upper angularly displaced inclined guiding part for guiding refuse, which is falling by gravity, adapted to be received into the elongate cab canopy portion of the body, and a lower packer part, so that refuse entering the body through the upper hopper loading opening is guided by the upper angularly displaced inclined guiding part into a position to be acted upon by the lower packer part; and, power operated means for causing reciprocal packing movement of the compacting platen to urge the deposited refuse rearwardly in the body.

In an exemplary alternate embodiment on a side loading vehicle, the invention is directed to a refuse collection and hauling apparatus comprising an elongated hollow body arranged for mounting on a motor truck, or the like vehicle chassis, the body being of uniform octagonal cross-section throughout its length at any given point, having a hopper section to receive refuse therein at its forward end, and an opposite open rear end; the hopper section is adapted to receive refuse therein loaded from a position adjacent the side of the hopper section of the body; a discharge door member pivotally connected to the body adjacent the opening in the rear end of the body; means for supporting the discharge door for pivotal movement between a first closed position sealing the opening, and a second discharge position exposing the opening; hydraulic means operatively coupled to the support means for providing selective movement between the first and second positions; compacting means within the body for longitudinal movement therein to compress rearwardly, against the discharge door, refuse loaded into the hopper section, the compacting means having a compacting platen mounted for movement longitudinally in the body, so that refuse deposited in the hopper section of the body is in a position to be acted upon by the compacting platen; and, power operated means for causing reciprocal packing movement of the compacting platen to urge the deposited refuse rearwardly in the body.

In a preferred embodiment on a front loading or a side loading vehicle, the power operated means for causing reciprocal packing movement of the compacting platen will comprise at least two hydraulic cylinders in a vertically spaced and generally X-shaped parallel relation to a horizontal datum. One end of each cylinder is operatively attached to the forward end of the body, while the opposite end of each cylinder is operatively attached to the compacting platen. This aspect of the invention results in a greater packing ability and corresponding carrying load over known prior art devices. Also, the positioning and placement of the cylinders results in less wear on the apparatus as the compacting forces exerted by the cylinders are aligned with the wear points of the body and not against the wear points. Finally, the positioning and placement of the cylinders causes the compacting force exerted by the cylinders to increase in magnitude as the compacting platen moves rearward, so that a maximum force is exerted by the compacting platen at the rearward terminus of its travel.

The preferred embodiment of the invention on either a front-end or side loader vehicle also has the body pivotally mounted on a motor truck or the like vehicle chassis and a power operated body elevating means operatively connected between the body and the chassis for pivoting the forward closed end of the body upwardly away from the chassis in an arcuate fashion to dump its contents through the opening in the rear end of the body.

These and other objects of the invention will become more apparent from the hereinafter following commentary taken in conjunction with the following Figures of Drawings.

DESCRIPTION OF THE BEST EMBODIMENTS COMTEMPLATED

Figure 1:
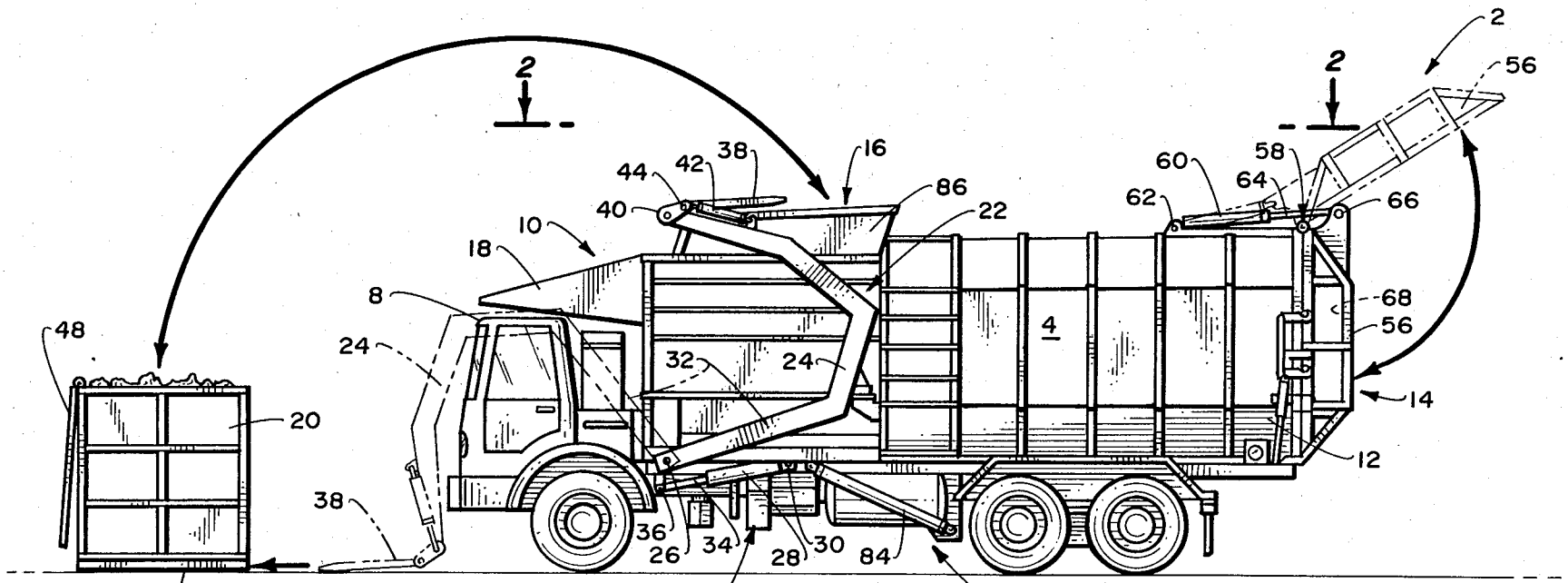
FIG. 1 is a side elevational view of the device of the invention shown mounted on a motor truck chassis.
Figure 2:
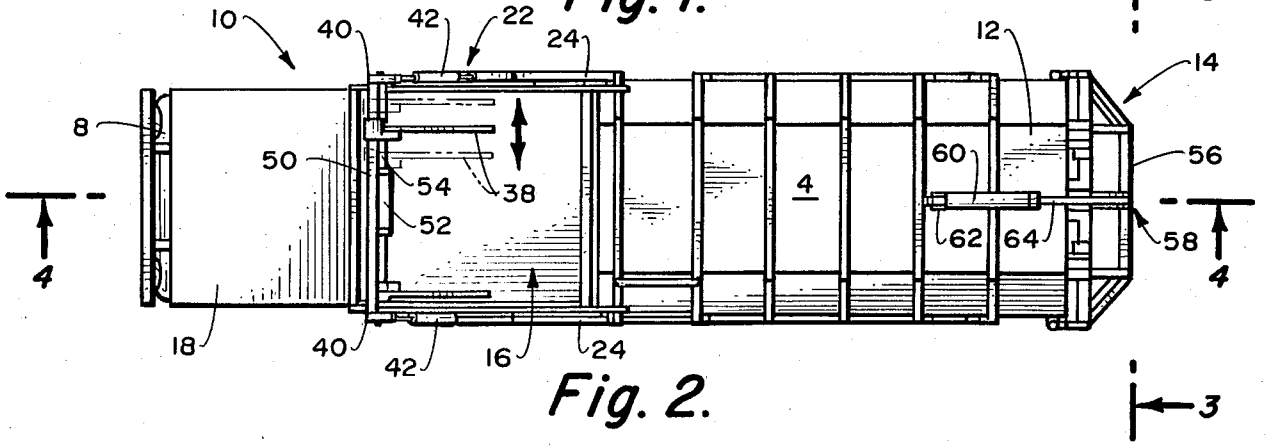
FIG. 2 is a top plan view taken along the line 2—2 of FIG. 1.
Figure 3:
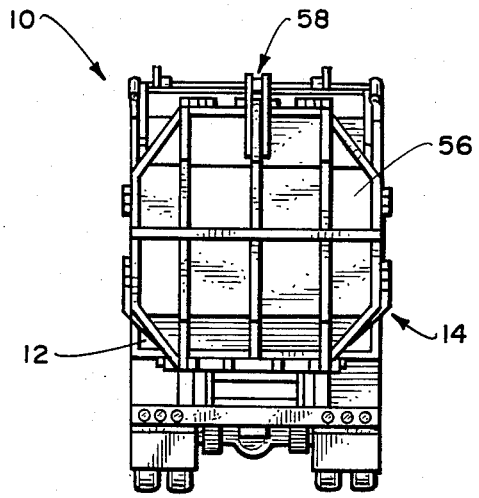
FIG. 3 is a rear elevational view taken along the line 3—3 of FIG. 2.

Referring to the figures of drawings wherein like numbers of reference designate like elements throughout, it will be noted that in a preferred embodiment of the invention for use as a front end loading vehicle, the refuse hauling device of the invention generally referred to as 2 comprises an elongated hollow body 4 arranged for mounting on a motor truck chassis 6 having a cab 8. Body 4 has a uniform cross-section at any given point throughout its length, of that of an octagonal frustrum with a slope of about 6 degrees from a datum. Body 4 is closed on a forward end 10 and open on an opposite rear end 12 with discharge opening 14. An upper loading opening 16 is located in body 4 spaced longitudinally from discharge opening 14 for depositing refuse within the body. The forward end 10 of body 4 has an elongated cab canopy portion 18 adapted to project outwardly over cab 8.

In the preferred front end loader embodiment of the invention, best seen in FIG. 1, there is provided means on body 4 for lifting a refuse collection container 20 to dump refuse from container 20 into body 4 from upper loading opening 16 and for thereafter lowering container 20 to ground level.

More specifically, a front end loader assembly 22 comprises lifting arms 24 mounted on body 4 through pivotal mountings 26.

Hydraulic cylinders 28, supported through pivotal mountings 30, are connected to lever arm portions 32 of lifting arms 24 through piston rods 34. Piston rods 34 are secured to lever arm portions 32 through pivotal mountings 36 with expansion of hydraulic cylinders 28 causing upward rotational movement of lifting arms 24 while contraction of the cylinders causes downward rotartional movement of the lifting arms.

Fork arms 38 are positioned adjacent the outer ends of lifting arms 24 through pivotal mountings 40, with the fork arms being rotatable with respect to the lifting arms through expansion or contraction of hydraulic cylinders 42 secured to the lifting arms 24 through pivotal mountings 44. As best seen in FIG. 1, the lifting arms 24, and form arms 38, are used to engage a refuse collection container 20 with fork arms 38 in engagement with fork slots 46 positioned on either side of the refuse collection container 20.

Fork arms 38 may be slidably mounted on a transverse track 50, connected at its ends to the outer ends of lifting arms 24, and selectively varied in their spacing from one another by expansion or contraction of hydraulic cylinder 52 mounted to track 50 and connected to at least one of the fork arms 38 through piston rod 54.

With fork arms 38 engaging fork slots 46, the refuse collection container 20 is lifted rearward and over cab 8 in an arcuate fashion through upward rotation of lifting arms 24. When the refuse collection container is lifted to a point above and adjacent upper loading opening 16 in body 4, fork arms 38 are rotated with respect to lifting arms 24, so as to invert the refuse collection container 20 and dump its contents into body 4. During inversion of refuse collection container 20, a container lid 48 which may be pivotally secured to the refuse collection container is rotated to an open position to permit dumping of the contents of the refuse collection container.

A discharge door 56 is secured to the rearward portion of body 4 through pivotal mountings 58. An hydraulic cylinder 60 supported on body 4 by pivotal mountings 62 is connected to door 56 through piston rod 64. Piston rod 64 is secured to door 56 through pivotal mounting 66 and adapted so that contraction of hydraulic cylinder 60 causes upward rotational movement of door 56, while expansion of the cylinder causes downward rotational movement of door 56. The principal function of door 56 is to close rearward opening 14 in body 4 to permit the packing and retention of refuse within body 4. Then, after body 4 becomes filled with refuse, the refuse may be dumped from body 4 by opening discharge door 56.

An absorption board 68 is mounted on the interior surface of discharge door 56 to absorb stress forces exerted against discharge door 56 by repeated operation of the compacting means and the compacted refuse itself. In operation, absorption board 68 prevents dimpling or dinging of the discharge door by absorbing such deforming stress-induced forces, thereby providing not only an aesthetic safeguard to the appearance of body 4 and discharge door 56, but also permitting a greater carrying work load in body 4 by allowing greater compacting forces to be exerted against discharge door 56.

Figure 4:
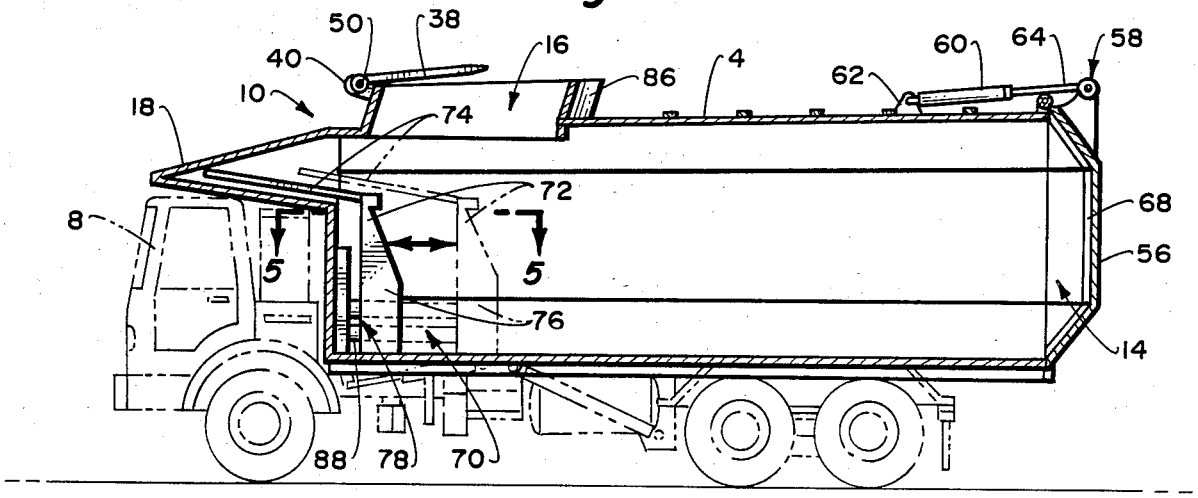
FIG. 4 is a cross-sectional view taken along the line 4—4 of FIG. 2.

Compacting means, generally indicated by 70 in FIG. 4, is positioned within body 4 for longitudinal movement therein to compress rearwardly against discharge door 56 refuse loaded into body 4 through upper loading opening 16.

Compacting means 70 has a compacting platen 72 mounted for movement longitudinally in body 4. Compacting platen 72 has an upper, angularly displaced inclined guiding part 74 for guiding refuse falling by gravity through upper loading opening 16 into a position to be acted upon by a lower packer part 76 of platen 72. Upper platen part 74 is adapted so that when platen 72 is in its extreme forward position in body 4, it is received within the interior of the elongated cab canopy portion 18 in the forward end 10 of body 4.

Figure 5:
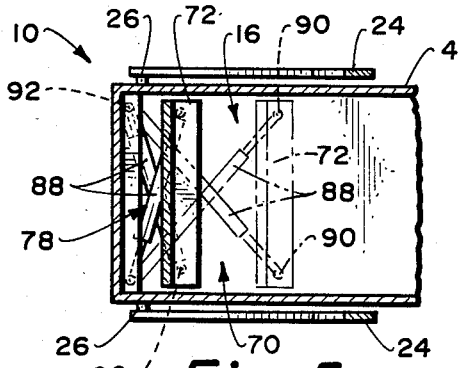
FIG. 5 is a fragmented view of the actuator system for the compaction blade; taken along the line 5—5 of FIG. 4.

A power operated means, for causing reciprocal packing movement of compacting platen 72, is indicated generally by 78. A preferred embodiment of power operated compacting means 78, as illustrated in FIG. 5, comprises at least two hydraulic cylinders 88 in a vertically spaced and generally X-shaped parallel relation to a horizontal datum. One end 90 of each cylinder is operatively attached to compacting platen 72. The opposite end 92 of each cylinder is operatively attached to forward end 10 of body 4.

The positioning and placement of cylinders 88 permits a greater compacting force to be exerted by the cylinders which increases in magnitude as compacting platen 72 moves rearward, so that a maximum compacting force is exerted at the rearward terminus of the compacting platen's travel.

Power operated compacting means 78 may also use a screw drive, or the like device, in place of hydraulic cylinders 88.

There is also provided, as best seen in FIG. 1, a power operated body elevating means generally referred to as 80, operatively connected between body 4 and chassis 6 for pivoting the forward end 10 of body 4 upwardly in an arcuate fashion away from chassis 6 to dump its contents through rear opening 14 in rear end 12 of body 4.

Referring more particularly to FIG. 1, body 4 is pivotally connected to the rear end of chassis 6 by a pivot pin and hinge arrangement, not illustrated, located generally over or near the rear wheel axles. Power means, such as hydraulic hoist cylinder 84, may be mounted between the forward end 10 of body 4 and chassis 6 and operating to pivot body 4 upwardly, in an arcuate fashion, about the rearward pivot pin and hinge arrangement connecting body 4 and chassis 6 to dump any refuse contained in body 4 through opening 14 at a dump or any other desired location.

A preferred embodiment of the invention will have the power operated body elevating means 80 to pivot body 4 so located that hydraulic hoist cylinder 84 will form an almost perpendicular angle with the ground when body 4 has pivoted upward in an arcuate fashion to an angle of approximately 46 degrees in relation to the ground. Having hydraulic hoist cylinder 84 almost perpendicular to the ground will provide the vehicle with improved stability while body 4 is in its raised dumping position.

Compacting means 70 may also be engaged to assist the removal of refuse from body 4.

To aid in guiding refuse dumped from refuse collection container 20 into body 4, there is provided a funnel-like, outwardly projecting lateral wall 86 (referred to as "windshields" in the art) surrounding upper loading opening 16 which is adapted to receive refuse collection container 20 and funnel or guide refuse falling therefrom into body 4.

Figure 6:
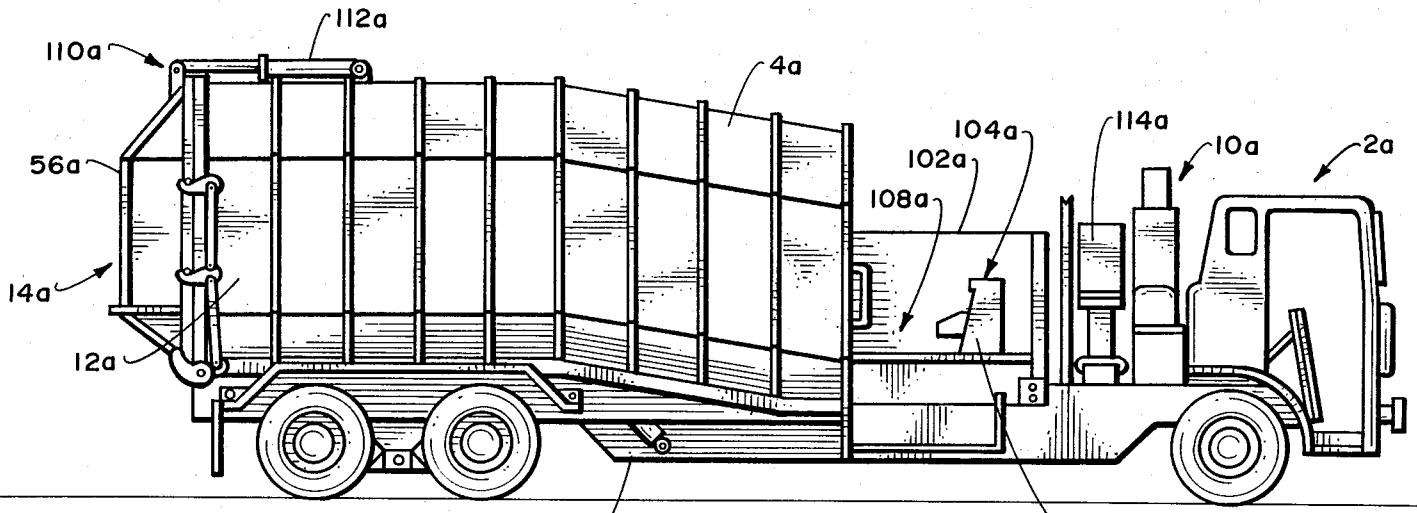
FIGS. 6 and 7 are side elevational views of alternate embodiments.
Figure 7:
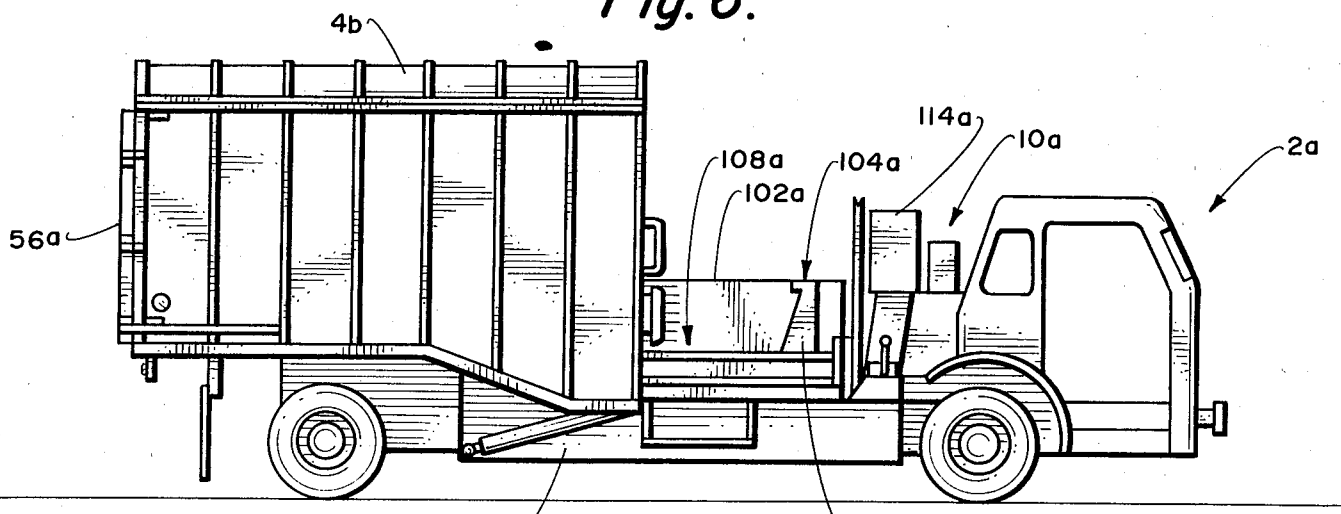

In the alternate preferred side-loader embodiment of the invention, best seen in FIGS. 6 and 7, the reference numbers 2*a* etc. are similar to those reference numbers and items described above in the preferred front-end loader embodiment of the invention.

Generally, an exemplary alternate embodiment of the invention for use as a side-loader refuse collection and hauling apparatus 2*a* comprises an elongated hollow body 4*a* adapted for mounting on a motor truck, or the like chassis 6*a*. Elongated hollow body 4*a* has a hopper section 108*a* to receive refuse therein at its forward end 10*a*.

The uniform shape of body 4 described above may be modified in the side-loader embodiment as suggested in FIGS. 6 and 7 to body 4*a* and 4*b*, to conform to the chassis 6*a* for mounting stability and ease.

Hopper section 108*a* is adapted to receive refuse therein loaded from a position adjacent the sides of hopper section 108*a* of body 4*a*.

A discharge door member 56*a* is pivotally connected to body 4*a* adjacent an opening 14*a* in rear end 12*a* of body 4*a*.

Means 110*a* is for supporting discharge door 56*a* for pivotal movement between a first closed position sealing opening 14*a*, and a second discharge position exposing opening 14*a*.

Hydraulic means 112*a* operatively coupled to support means 110*a* for providing selective movement between the first and second positions is shown in FIGS. 6 and 7 and is similar to that described above for the preferred front-loader embodiment of the invention.

A wind screen wall 102*a* is provided to prevent the loss of refuse deposited into hopper section 108*a* due to gusty wind conditions.

Compacting means 104*a* has a packing platen 106*a* adapted for longitudinal movement within hopper section 108*a*, to compress rearwardly, against discharge door 56*a*, refuse loaded into hopper section 108*a*.

Packing platen 106*a* is adapted so that refuse deposited in hopper section 108*a* of body 4*a* is in a position to be acted upon by the packing platen 106*a*.

Power operated means 114*a* for causing reciprocal packing movement of packing platen 106*a* to urge the refuse deposited in hopper section 108*a* rearwardly into body 4*a* is shown in FIGS. 6 and 7.

The invention described above is, of course, susceptible of many variations, modifications and changes, all of which are within the skill of the art. It should be understood that all such variations, modifications and changes are within the spirit and scope of the invention and of the appended claims. Similarly, it will be understood that it is intended to cover all changes, modifications and variations of the example of the invention herein disclosed for the purpose of illustration which do not constitute departures from the spirit and scope of the invention.

What is claimed is:

1. A refuse handling device comprising an elongated, hollow body arranged for mounting on a motor truck chassis or the like having a cab, said body being of uniform, polygonal cross-section throughout its length, closed on a forward end and open on an opposite rear end, and having an upper loading therein spaced longitudinally from said open end for depositing refuse within the body, said forward closed end having an elongated cab canopy portion adapted to project outwardly over said motor truck chassis cab; means on said body for lifting a refuse container to dump refuse from the container into said body through said upper loading opening and for thereafter lowering said container; a closure means associated with said open end of said body for releasably closing said rear opening in said body; compacting means within said body for longitudinal movement therein to compress against said closure means refuse loaded thereinto through said upper loading opening having a compacting platen mounted for movement longitudinally in said body and having an upper angularly displaced inclined guiding part extending a sufficient distance forward thereof for guiding refuse which is falling by gravity, rearward of the position of said compacting platen within said body, and being adapted to be received into said elongated cab canopy portion of said body when said compacting platen is positionally located in said hollow body substantially adjacent said upper loading opening for accepting refuse passing therethrough, and a lower packer part, so that refuse entering said body through said upper loading opening is guided by said upper angularly displaced inclined guiding part into a position to be acted upon by said lower packer part, and power operated means for causing reciprocal packing movement of said compacting platen to urge said deposited refuse rearwardly in said body.

2. The device in accordance with claim 1 wherein said power operated means for causing reciprocal packing movement of said compacting platen, is at least two hydraulic cylinders in a vertically spaced and generally X-shaped parallel relation to a horizontal datum, each having one end operatively connected to said body and the opposite end operatively connected to said compacting platen.

3. The device in accordance with claim 1 further including having said body pivotally mounted on said motor truck chassis; and, power operated body elevating means operatively connected between said body and said chassis for pivoting said closed end of said body upwardly away from said chassis to dump its contents through said opening in said rear end of said body.

4. The device in accordance with claim 3 wherein said power operated body elevating means is at least one hydraulic cylinder operatively connected between said body and said chassis for pivoting said closed end of said body upwardly away from said chassis in an arcuate fashion and adapted to form an almost perpendicular angle in relation to a horizontal datum when said body has been pivoted upwardly to form an approximately 46 degree angle from said horizontal datum.

5. The device in accordance with claim 4 wherein said closure means associated with said open end of said body for releasably closing said rear opening in said body comprises: a discharge door member pivotally connected to said body adjacent said opening in said rear end of said body; means for supporting said discharge door for pivotal movement between a first closed position sealing said opening and a second discharge position exposing said opening; and, power means operatively coupled to said support means for providing selective movement between said first and second positions.

6. The device in accordance with claim 5 further including an absorption board operatively attached to said discharge door.

7. The device in accordance with claim 6 wherein said discharge door is convex in shape.

8. The device in accordance with claim 7 wherein said upper loading opening is adapted to receive said refuse collection container dumping refuse into said body.

9. The device in accordance with claim 8 further including a funnel-like outwardly projecting lateral wall surrounding said upper loading opening adapted to funnel refuse being dumped from said refuse container into said body through said upper loading opening.

10. The device in accordance with claim 9 wherein the cross-section of said body throughout its length is that of an octagonal frustrum.

11. The device in accordance with claim 10 wherein the slope of said octagonal frustrum is about 6 degrees from a datum.

12. A refuse handling device comprising: an elongated, hollow body arranged for mounting on a motor truck chassis having a cab, said body having a uniform cross-section throughout its length of that of a polygonal frustrum with a slope of about 6 degrees from a datum, closed on a forward end and open on an opposing rear end, and having an upper loading opening therein spaced longitudinally from said rear open end for depositing refuse within the body, said forward closed end having an elongated cab canopy portion adapted to project outwardly over said motor truck chassis cab; means on said body for lifting a refuse container to dump refuse from said container into said body through said upper loading opening and for thereafter lowering said container; a discharge door member having a convex shape pivotally connected to said body adjacent said rear opening in said body; means for supporting said discharge door for pivotal movement between a first closed position sealing said rear opening and a second discharge position exposing said rear opening; hydraulic means operatively coupled to said support means for providing selective movement between said first and second positions; compacting means within said body for longitudinal movement therein to compress against said discharge door refuse loaded thereinto through said upper loading opening having a compacting platen mounted for movement longitudinally in said body and having an upper, angularly displaced inclined guiding part extending a sufficient distance forward of said compacting platen for guiding refuse which is falling by gravity and adapted to be received into said elongated cab canopy portion forward of said body when said compacting platen is positionally located with respect to said upper loading opening for accepting refuse passing therethrough and a lower packer part, so that refuse entering said body through said upper loading opening regardless of the position of said compacting means in said body is guided by said upper angularly displaced inclined guiding part into a position to be acted upon by said lower packer part, and power operated means for causing reciprocal packing movement of said compacting platen to urge said deposited refuse rearwardly in said body; said body pivotally mounted on said motor truck chassis; and, power operated body elevating means operatively connected between said body and said chassis to dump its contents through said opening in said rear end of said body.

13. The device in accordance with claim 12 wherein said power operated body elevating means is at least one hydraulic cylinder operatively connected between said body and said chassis for pivoting said closed end of said body upwardly away from said chassis in an arcuate fashion and adapted to form an almost perpendicular angle in relation to a horizontal datum when said body has been pivoted upwardly to form an approximately 46 degree angle from said horizontal datum.

14. The device in accordance with claim 1 wherein the shape of said body is that of an octagonal frustrum having a slope approximating 6 degrees from a datum.

* * * * *